US010301907B2

(12) United States Patent
Budde

(10) Patent No.: US 10,301,907 B2
(45) Date of Patent: May 28, 2019

(54) SETTING TOOL WITH PRESSURE SHOCK ABSORBER

(71) Applicant: Weatherford Netherlands, B.V., Den Helder (NL)

(72) Inventor: Marcel Budde, Vlaardingen (NL)

(73) Assignee: Weatherford Netherlands, B.V., Den Helder (NL)

( * ) Notice: Subject to any disclaimer, the term of this patent is extended or adjusted under 35 U.S.C. 154(b) by 456 days.

(21) Appl. No.: 14/868,049

(22) Filed: Sep. 28, 2015

(65) Prior Publication Data

US 2017/0089174 A1 Mar. 30, 2017

(51) Int. Cl.

| | |
|---|---|
| ***E21B 34/10*** | (2006.01) |
| ***E21B 43/10*** | (2006.01) |
| *E21B 34/00* | (2006.01) |

(52) U.S. Cl.

CPC ..... *E21B 34/10* (2013.01); *E21B 43/10* (2013.01); *E21B 2034/007* (2013.01)

(58) Field of Classification Search

CPC ..... E21B 34/10; E21B 43/10; E21B 2034/007
See application file for complete search history.

(56) References Cited

U.S. PATENT DOCUMENTS

| | | | | |
|---|---|---|---|---|
| 4,254,836 | A | 3/1981 | Russell | |
| 4,632,187 | A | 12/1986 | Deaton | |
| 4,893,678 | A * | 1/1990 | Stokley | E21B 34/14 166/238 |
| 5,375,662 | A | 12/1994 | Echols, III et al. | |
| 5,465,787 | A | 11/1995 | Roth | |
| 6,206,094 | B1 | 3/2001 | Smith, Jr. | |
| 6,253,861 | B1 | 7/2001 | Carmichael et al. | |
| 6,896,064 | B2 * | 5/2005 | Howlett | E21B 47/1025 166/183 |
| 6,920,930 | B2 | 7/2005 | Allamon et al. | |
| 7,416,029 | B2 | 8/2008 | Telfer et al. | |
| 8,448,700 | B2 | 5/2013 | Connell et al. | |
| 8,739,864 | B2 | 6/2014 | Crider et al. | |
| 8,844,622 | B2 | 9/2014 | Telfer | |
| 8,960,333 | B2 * | 2/2015 | Radford | E21B 10/322 175/268 |
| 9,470,059 | B2 * | 10/2016 | Zhou | E21B 43/10 |
| 2011/0278016 | A1 | 11/2011 | Xu | |
| 2012/0067426 | A1 | 3/2012 | Soni et al. | |
| 2013/0319767 | A1 | 12/2013 | Wilson et al. | |

(Continued)

OTHER PUBLICATIONS

Australian Patent Examination Report dated Nov. 24, 2016, for Australian Patent Applicaiton No. 2016225805.

(Continued)

*Primary Examiner* — Benjamin F Fiorello
(74) *Attorney, Agent, or Firm* — Patterson & Sheridan, LLP

(57) ABSTRACT

A setting tool includes a housing, a mandrel disposed in a bore of the housing, a sleeve disposed between the mandrel and the housing, the sleeve movable from a first position to a second position, a biasing member for biasing the sleeve towards the second position, a first fluid flow path through a bore of the mandrel, and a second flow path in an annulus formed between the mandrel and the housing, wherein the sleeve blocks fluid flow through the second flow path when the sleeve is in the second position.

19 Claims, 5 Drawing Sheets

(56) References Cited

U.S. PATENT DOCUMENTS

| | | | |
|---|---|---|---|
| 2014/0262508 | A1 | 9/2014 | Fuller et al. |
| 2014/0345875 | A1 | 11/2014 | Murphree et al. |

OTHER PUBLICATIONS

United Kingdom Combined Search and Examination Report dated Dec. 16, 2016, for Patent Application No. GB1615264.7.
Canadian Office Action dated Aug. 30, 2017, for Canadian Patent Application No. 2,940,998.
Australian Examination Report dated Sep. 6, 2017, for Australian Patent Application No. 2016225805.

* cited by examiner

SETTING TOOL WITH PRESSURE SHOCK ABSORBER

BACKGROUND OF THE INVENTION

Field of the Invention

The present disclosure generally relates to a setting tool.

Description of the Related Art

A wellbore is formed to access hydrocarbon bearing formations, e.g. crude oil and/or natural gas, or geothermal formations by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second liner string overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

The liner string is typically deployed to a desired depth in the wellbore using a workstring. A setting tool of the liner string is then operated to set a hanger of the liner string against a previously installed liner string. The liner hanger may include slips riding outwardly on cones in order to frictionally engage the surrounding liner string. The setting tool is typically operated by pumping a ball to a seat located in or below the setting tool. In some instances, fluid pressure levels used to seat the ball and/or actuate the liner hanger cause damage to the setting tool. Thus, what is needed is an improved setting tool for handling relatively high fluid pressure levels.

SUMMARY OF THE INVENTION

A setting tool includes a housing; a mandrel disposed in a bore of the housing; a sleeve disposed between the mandrel and the housing, the sleeve movable from a first position to a second position; a biasing member for biasing the sleeve towards the second position; a first fluid flow path through a bore of the mandrel; and a second flow path in an annulus formed between the mandrel and the housing, wherein the sleeve blocks fluid flow through the second flow path when the sleeve is in the second position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a longitudinal axis of a wellbore, and "below", "lower", "downward" and similar terms refer to a direction away from the earth's surface along the longitudinal axis of the wellbore.

Figure 1:
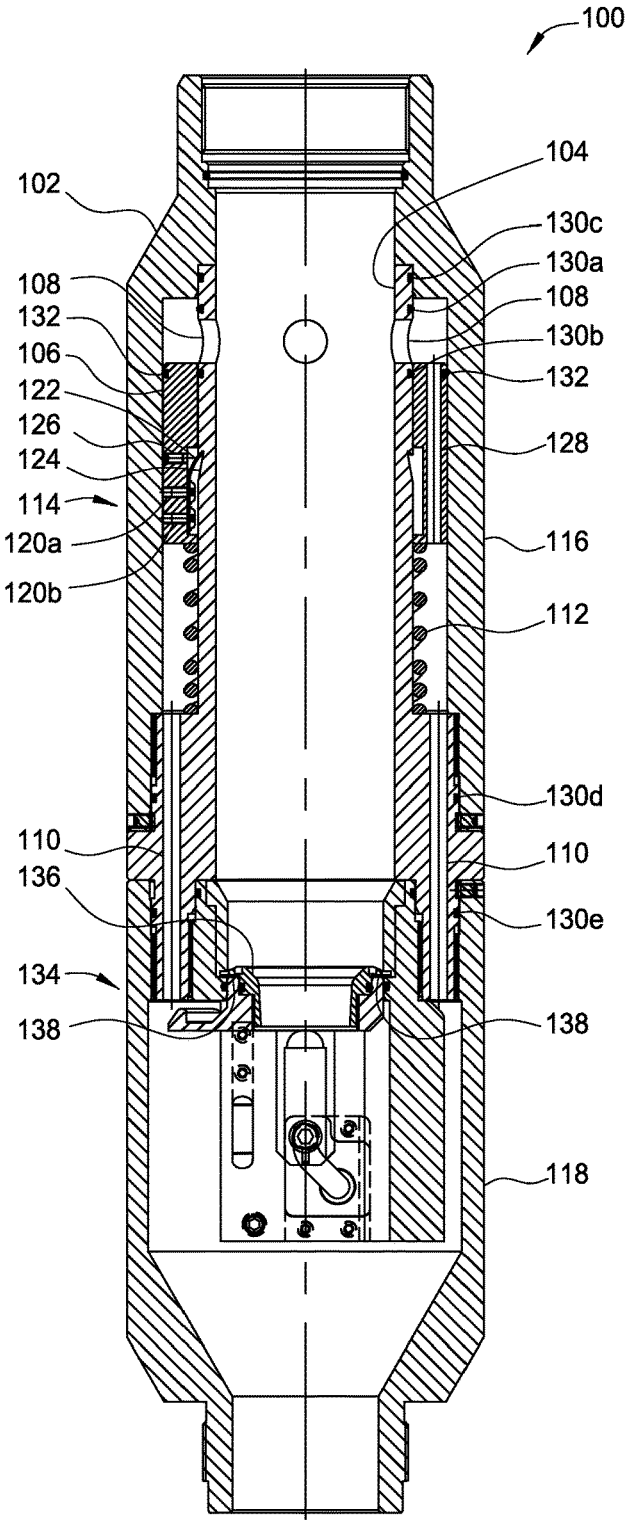
FIG. 1 illustrates a cross sectional view of an exemplary embodiment of a setting tool in a first position.

FIG. 1 illustrates an exemplary embodiment of a setting tool 100. The setting tool 100 includes a housing 102, an inner mandrel 104, a piston sleeve 106, and a seat assembly 134.

In one embodiment, the housing 102 may have an upper portion 116 and a lower portion 118 connected by the inner mandrel 104 as shown in FIG. 1. Alternatively, the upper and lower portions 116, 118 of the housing 102 are integrally formed. The housing 102 and the inner mandrel 104 each include a bore extending therethrough. The inner mandrel 104 is disposed in the bore of the housing 102. The piston sleeve 106 is disposed between the inner mandrel 104 and the housing 102. For example, the housing 102 includes an enlarged inner diameter wherein the piston sleeve 106 is movably disposed. The inner mandrel 104 is provided with seals 130*a* and 130*b* on an outer surface for sealingly engaging the piston sleeve 106. The inner mandrel also includes seals 130*c-e* on the outer surface for sealingly engaging the housing 102. The piston sleeve 106 is provided with a seal 132 on an outer surface for sealingly engaging the housing 102.

The seals 130*a-e* and 132 may include any appropriate sealing element as is known by one of ordinary skill in the art. As illustrated in FIGS. 1-5, the seals 130*a-e* and 132 are o-rings.

The setting tool 100 includes a bypass flow path for allowing fluid flow around the seat assembly 134. For example, the inner mandrel 104 includes a plurality of circumferentially spaced radial bypass ports 108 extending from an inner surface to the outer surface of the inner mandrel 104. The radial bypass ports 108 provide fluid communication between the bore of the inner mandrel 104 and the piston sleeve 106. In one embodiment, a sum of each cross sectional area of the radial bypass ports 108 is substantially equal to a cross sectional area of a bore through the seat assembly 134. For example, the sum of each cross sectional area of the radial bypass ports 108 ranges from 80% to 95%, such as 90%, of the cross sectional area of the bore of the seat assembly 134. The piston sleeve 106 includes a plurality of circumferentially spaced axial bypass ports 128 extending from a top surface to a bottom surface of the piston sleeve 106. Each axial bypass port 128 provides a flow path through the piston sleeve 106. In one embodiment, a sum of each cross sectional area of the axial bypass ports 128 is substantially equal to the cross sectional area of the bore of the seat assembly 134. For example, the sum of each cross sectional area of the axial bypass ports 128 ranges from 80% to 95%, such as 90%, of the cross sectional area of the bore of the seat assembly 134. In one embodiment, the inner mandrel 104 also includes a plurality of circumferentially spaced axial bypass ports 110. For example, the inner mandrel 104 may include a portion having an enlarged outer diameter, as shown in FIGS. 1-5. The enlarged outer diameter portion may include the axial bypass ports 110 extending from a top surface to a bottom surface of the enlarged diameter portion. Each axial bypass port 110 provides a flow path through the enlarged diameter portion of the inner mandrel 104. In one embodiment, a sum of each cross sectional area of the axial bypass ports 110 is substantially equal to the cross sectional area of the bore of the seat assembly 134. For example, the sum of each cross sectional area of the axial bypass ports 110 ranges from 80% to 95%, such as 90%, of the cross sectional area of the bore of the seat assembly 134. Alternatively, the plurality of axial bypass ports 110 may be formed in the housing 102 or a sleeve disposed between the inner mandrel 104 and the housing 102.

The piston sleeve 106 is movable from an open position (FIG. 1) to a closed position (FIG. 4) to block fluid flow through the bypass ports 108, 128, and 110. In the open position, the piston sleeve 106 allows fluid communication between the radial bypass ports 108 and the axial bypass ports 110 in the inner mandrel 104 via the axial bypass ports 128 in the piston sleeve 106. In the closed position, the piston sleeve 106 blocks fluid communication between the radial bypass ports 108 and the axial bypass ports 110 in the inner mandrel 104.

Initially, a releasable locking mechanism 114 prevents the piston sleeve 106 from moving in at least one direction, such as towards the closed position. In one embodiment, the locking mechanism 114 prevents upward movement of the piston sleeve 106 and allows downward movement of the piston sleeve 106. The locking mechanism 114 initially restrains the piston sleeve 106 in the open position. The locking mechanism 114 may be any appropriate releasable and/or shearable member as is known in the art, such as shear rings, shear pins, and/or adhesives. In one embodiment, the locking mechanism 114 is configured to release the piston sleeve 106 at a pressure lower than an actuation pressure of the setting tool 100 described in further detail below. In one embodiment, the locking mechanism 114 is disposed in a recess formed by an enlarged inner diameter in the piston sleeve 106. The locking mechanism 114 may include set screws 120*a* and 120*b* configured to couple a spring blade 122 to the piston sleeve 106. The spring blade 122 prevents the piston sleeve 108 from moving upward. For example, a first end of the spring blade 122 is fastened to an inner surface of the piston sleeve 106 using the set screws 120*a* and 120*b*. A second end of the spring blade 122 is not fastened to the piston sleeve 106. The second end of the spring blade 122 is initially disposed in a groove 124 formed on the outer surface of the inner mandrel 104. The second end of the spring blade 122 may be set in the groove 124 by inserting an installation member, such as an installation set screw, through a hole 126 in the piston sleeve 106 in order to force the second end of the spring blade 112 into the groove 124. Thereafter, the second end of the spring blade 122 remains in the groove 124 due to an upward force exerted on the piston sleeve 106. For example, the piston sleeve 106 is biased upwards relative to the housing 102 and the inner mandrel 104 (i.e., towards the closed position) by a biasing member 112. As illustrated in FIGS. 1-5, the biasing member 112 may be a helical spring or any other appropriate biasing member as is known in the art.

The setting tool 100 may include any appropriate number of locking mechanisms 114 such as one to six locking mechanisms 114.

In one embodiment, the seat assembly 134 includes a seat 136 in the bore of the inner mandrel 104, as shown in FIG. 1. The seat 136 includes a bore therethrough for allowing fluid through the seat assembly 134. The seat 136 is movable between a first position (FIGS. 1-4) in which the seat 136 is configured to receive an actuating member 202, such as a ball, and a second position (FIG. 5) in which the seat 136 moves the actuating member 202 to allow fluid flow through the bore of the inner mandrel 104. The seat assembly 134 also includes a shearable member 138 for holding the seat 136 in the first position. The shearable member 138 may include a shear ring, as illustrated in FIGS. 1-5, or any other appropriate shearable member as known in the art. The shearable member 138 is set to shear at a predetermined threshold pressure in the housing 102.

The setting tool 100 may be coupled to a tubular string at an upper and/or lower end thereof, such as by threaded connections. The tubular string may include any appropriate number of setting tools 100. The setting tool 100 may be used in a wellbore having any appropriate angle relative to vertical. For example, the wellbore may be substantially horizontal relative to vertical, such as greater than 60°, 70°, 75°, and/or 80° from vertical.

In operation, the setting tool 100 is lowered into the wellbore as shown in FIG. 1. Next, fluid is circulated through the setting tool 100. A first portion of fluid flows through the bore of the inner mandrel 104 and the bore of the seat 136. A second portion of fluid flows through the bypass formed by the piston sleeve 106 and the inner mandrel 104. For example, the second portion of fluid flows into the radial bypass ports 108 and passes through the axial bypass ports 128 in the piston sleeve 106. Next, the second portion of fluid passes through the axial bypass ports 110 in the inner mandrel 104 and reenters the bore of the housing 102 below the seat 136.

Figure 2:
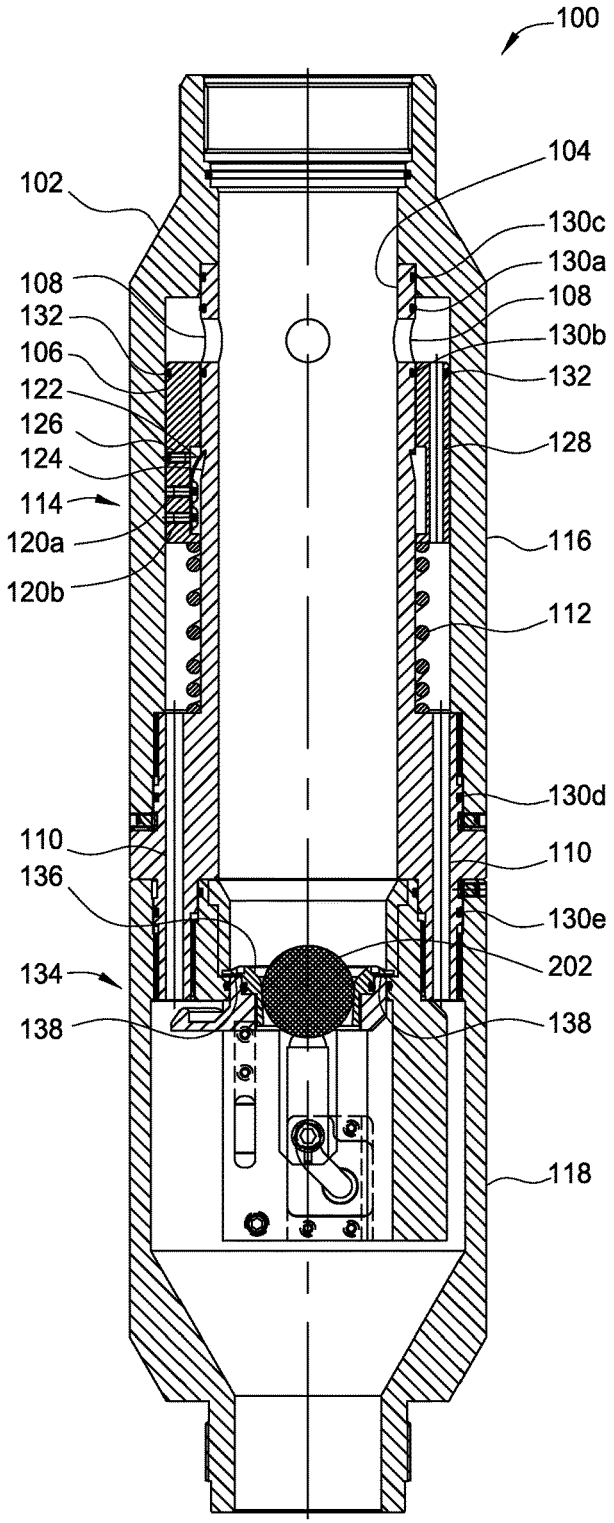
FIG. 2 is a cross sectional view of the setting tool of FIG. 1 and an actuating member in a first position.

Thereafter, the actuating member 202 may be released into the tubular string. In the embodiment where the setting tool 100 is in the substantially horizontal wellbore, gravity may cause the actuating member 202 to land on the inner surface of the inner mandrel 104. Additional fluid pressure may be applied to land the actuating member 202 in the seat 138, as shown in FIG. 2. By landing the actuating member 202 in the seat 138, circulation pressure in the housing 102 increases, thereby indicating that the actuating member 202 successfully landed in the seat 138. Furthermore, by landing the actuating member 202, the shearable member 138 may experience a hammer effect caused by an impact between the actuating member 202 and the seat 138. The hammer effect may be amplified after the actuating member 202 lands in the seat 138. For example, a force exerted by the actuating member 202 plus a force exerted by a fluid column above the actuating member 202 amplifies the hammer effect. The hammer effect may cause the shearable member 138 to shear at a pressure lower than the predetermined threshold pressure. The bypass prevents the hammer effect on the shearable member 138 by providing an alternate path for the fluid in the housing 102, thereby relieving the force exerted on the shearable member 138.

Figure 3:
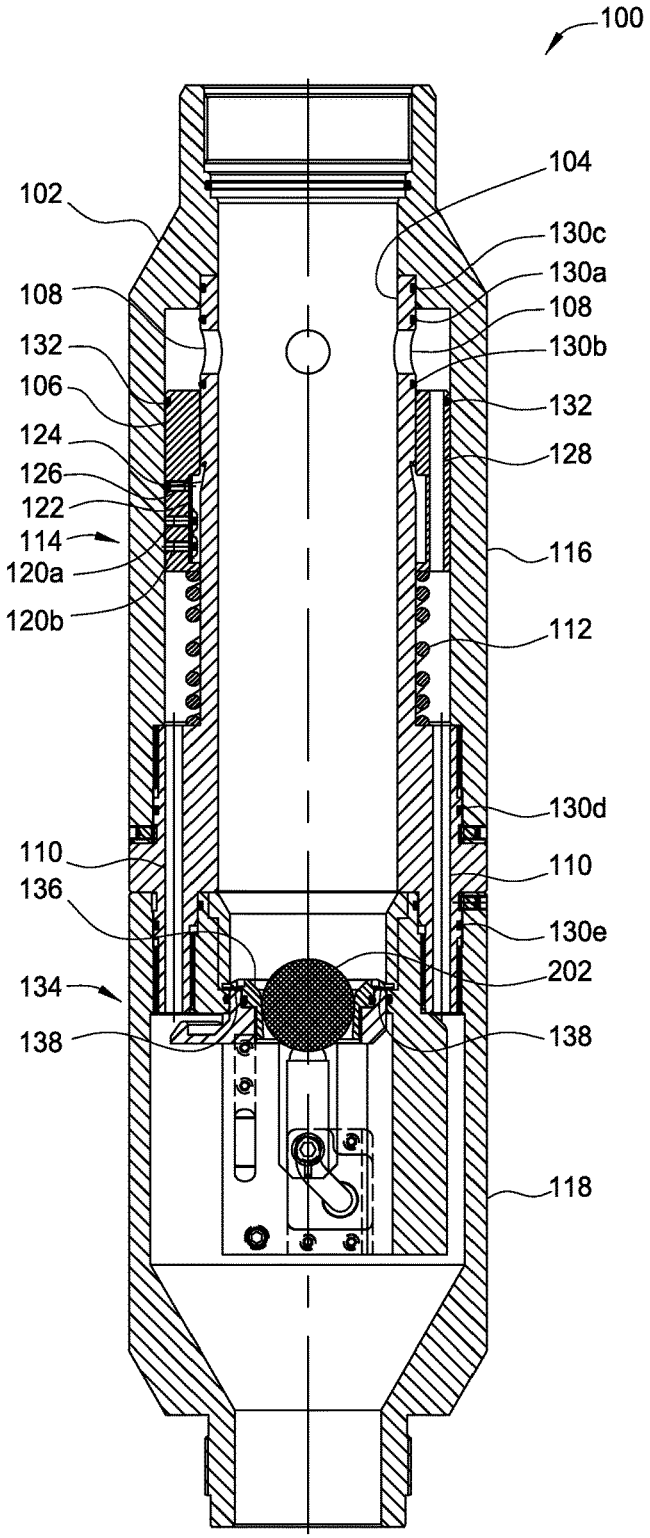
FIG. 3 is a cross sectional view of the setting tool of FIG. 1 in a second position.

After the actuating member 202 lands in the seat 138, fluid flow through the bore of the inner mandrel 104 is blocked. Thereafter, fluid flows through the housing 102 via the bypass ports 108, 128, and 110. A fluid force on the top surface of the piston sleeve 106 counteracts a spring force provided by the spring 112 on the bottom surface of the piston sleeve 106. Increasing the fluid pressure in the housing 102 may cause the piston sleeve 106 to move downward relative to the housing 102 and the inner mandrel 104, as shown in FIG. 3. The fluid pressure required to overcome the spring force is set to be less than the predetermined threshold pressure of the shearable member 138. For example, the fluid force on the piston sleeve 106 may exceed the spring force, thereby causing the piston sleeve 106 to move downward. In turn, the locking mechanism 114 releases the piston sleeve 106 from the inner mandrel 104. Thereafter, the piston sleeve 106 is movable upward past the groove 124 in the inner mandrel 104. For example, by moving downward, the spring blade 122 moves out of the groove 124 and returns to an unbiased position whereby the spring blade 122 abuts the inner surface of the piston sleeve 106, as shown in FIG. 3. As a result, the spring blade 122 no longer impedes the upward movement of the piston sleeve 106.

Figure 4:
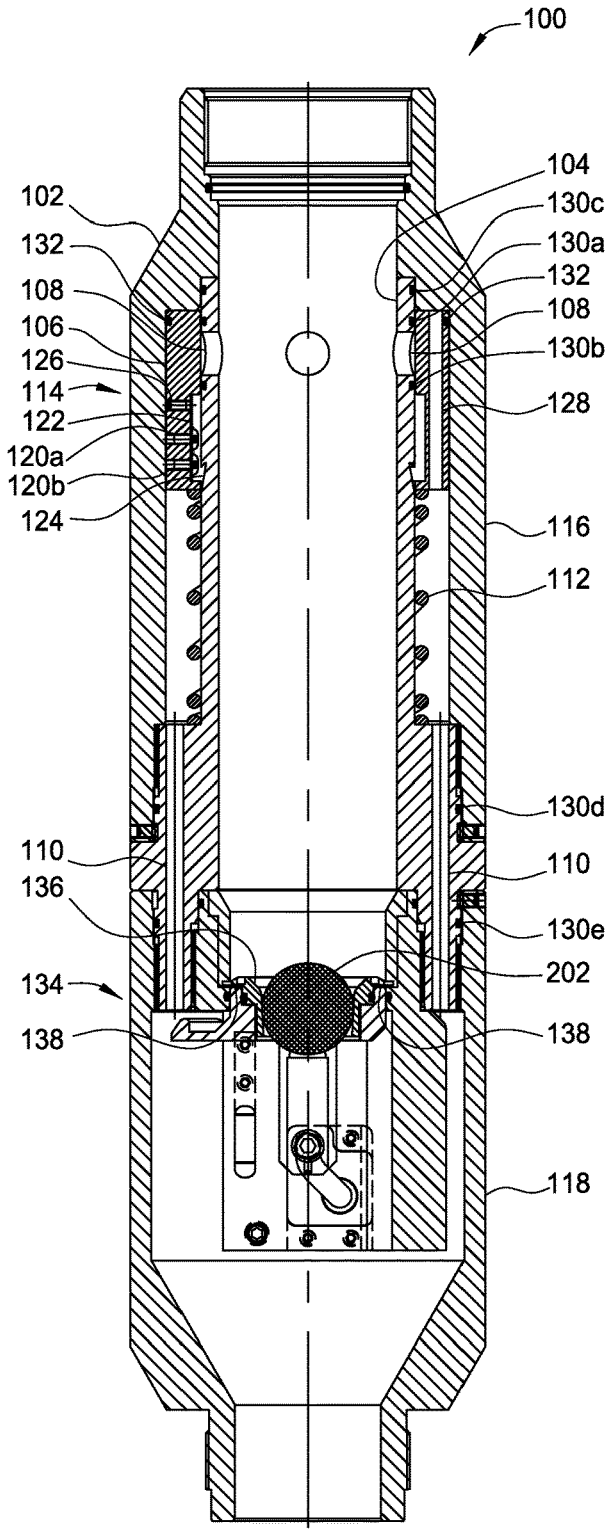
FIG. 4 is a cross sectional view of the setting tool of FIG. 1 in a third position.

Decreasing the fluid pressure in the housing 102 may cause the piston sleeve 106 to move upward relative to the housing 102 and the inner mandrel 104. For example, decreasing the fluid force on the top surface of the piston sleeve 106 to below the spring force results in the upward movement of the piston sleeve 106. After releasing the locking mechanism 114, upward movement of the piston sleeve 106 will block fluid flow through the bypass ports 108, 128, and 110, as shown in FIG. 4. For example, the piston sleeve 106 moves upward and sealingly engages the seals 130*a*, 130*b* of the inner mandrel 104 to prevent fluid flow out of the bore of the inner mandrel 104. After the piston sleeve 106 blocks fluid flow through the radial bypass ports 108, fluid injected into the housing 102 cannot move the piston sleeve 106 downward again.

Figure 5:
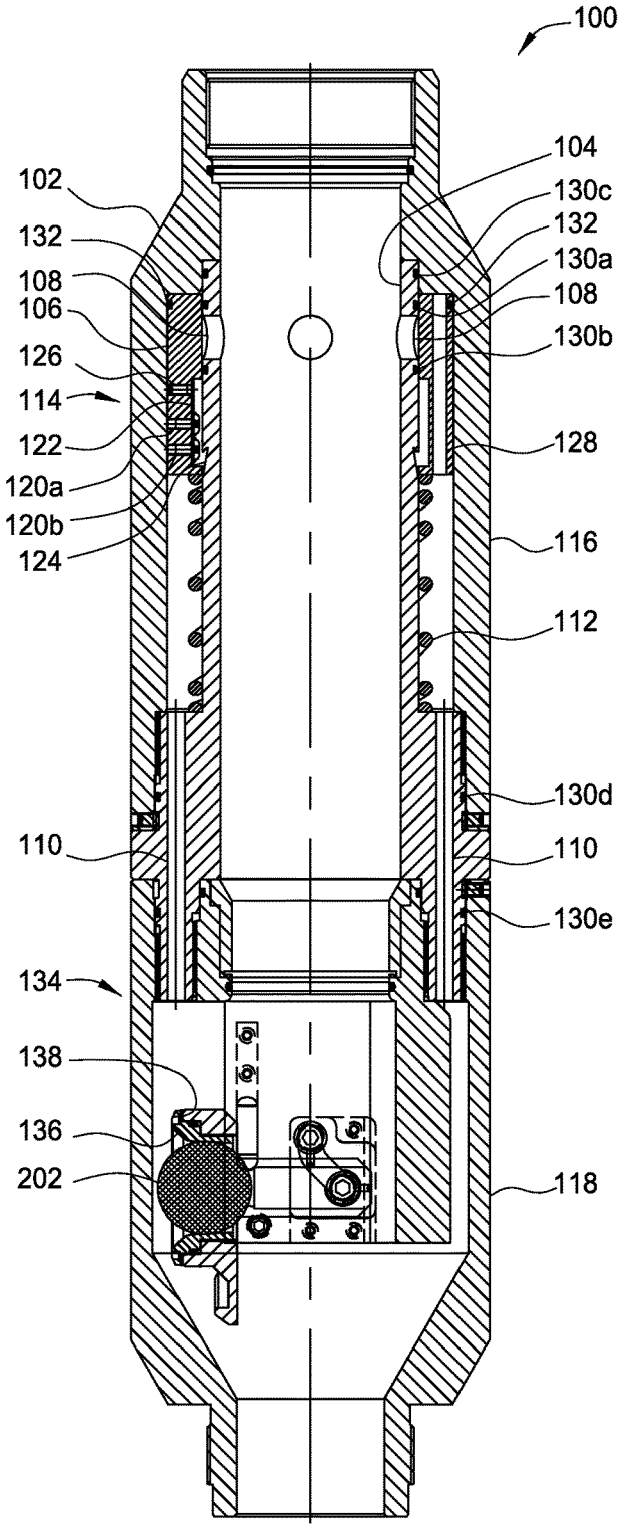
FIG. 5 is a cross sectional view of the setting tool of FIG. 1 and the actuating member in a second position.

After blocking the bypass, the setting tool 100 may be used to actuate other equipment on the tubular string. Examples of other equipment actuatable by the setting tool 100 include liner hangers, packers, isolation valves, and any other suitable equipment actuatable by fluid pressure. The other equipment may be actuatable via a predetermined actuation pressure in the tubular string. The actuation pressure of the other equipment is set to be less than the predetermined threshold pressure of the shearable member 138. After actuating the other equipment, fluid flow through the setting tool 100 may be reopened by increasing fluid pressure in the housing 102 to above the predetermined threshold pressure of the shearable member 138. In turn, the shearable member 138 shears and the seat 138 moves the actuating member 202 to unblock fluid flow through the bore of the inner mandrel 202. The seat 136 may move the actuating member 202 to unblock the bore of the inner mandrel 104 using any appropriate technique as is known by those of ordinary skill in the art. As illustrated in FIGS. 4 and 5, the seat 136 rotates from the first position to the second position.

The setting tool may be used for a variety of ball-drop activation tools and/or applications. An exemplary activation tool is a ball actuatable sliding sleeve. The setting tool advantageously allows for a higher flow rate to urge the drop ball into the activation tool. The setting tool is particularly useful in deviated bores, such as horizontal bores. The bore may be angled from 50° to 120° from vertical; for example, 60°, 70°, 75°, 80°, 85°, or 90° from vertical. The setting tool is also useful in bores angled upwards towards the surface, such as bores angled greater than 90° from vertical.

As will be understood by those skilled in the art, a number of variations and combinations may be made in relation to the disclosed embodiments all without departing from the scope of the invention.

In one embodiment, a setting tool includes a housing; a mandrel disposed in a bore of the housing; a sleeve disposed between the mandrel and the housing, the sleeve movable from a first position to a second position; a biasing member for biasing the sleeve towards the second position; a first fluid flow path through a bore of the mandrel; and a second flow path in an annulus formed between the mandrel and the housing, wherein the sleeve blocks fluid flow through the second flow path when the sleeve is in the second position.

In one or more embodiments described herein, the sleeve is releasably locked in the first position.

In one or more embodiments described herein, the mandrel includes a port providing fluid communication between the bore of the mandrel and a first side of the sleeve.

In one or more embodiments described herein, the sleeve includes a port providing fluid communication through the sleeve.

In one or more embodiments described herein, the mandrel includes a second port providing fluid communication between the bore of the housing and a second side of the sleeve.

In one or more embodiments described herein, the housing includes a second port providing fluid communication between the bore of the housing and the sleeve.

In one or more embodiments described herein, the sleeve is movable relative to the mandrel.

In one or more embodiments described herein, the setting tool includes a seat in the bore of the housing.

In another embodiment, a method of operating a setting tool includes flowing fluid through a first fluid path and a second fluid path; releasing an actuating member; landing the actuating member in the setting tool, thereby blocking fluid flow through the first fluid path; increasing fluid pressure in the setting tool, thereby moving a sleeve from a first position; and decreasing fluid pressure in the setting tool, thereby moving the sleeve from towards a second position to block fluid flow through the second fluid path.

In one or more embodiments described herein, the method includes setting a liner after moving the sleeve to the second position.

In one or more embodiments described herein, while the first fluid path is blocked fluid flows through the second fluid path.

In one or more embodiments described herein, fluid in the second fluid path flows around the landed actuating member.

In one or more embodiments described herein, the method includes unlocking the sleeve to allow movement towards the second position.

In one or more embodiments described herein, the sleeve is unlocked by moving the sleeve away from the second position.

In one or more embodiments described herein, the sleeve is unlocked by increasing fluid pressure above a predetermined pressure to unlock the sleeve.

In one or more embodiments described herein, the method includes increasing fluid pressure above a second predetermined pressure, thereby unblocking fluid flow through the first fluid path.

In one or more embodiments described herein, the second predetermined pressure is greater than the predetermined pressure.

In one or more embodiments described herein, after the sleeve is in the second position the sleeve cannot move towards the first position.

In one or more embodiments described herein, fluid flow through the second fluid path is blocked when the sleeve moves to the second position.

In another embodiment, a setting tool includes a mandrel; a sleeve in a first position relative to the mandrel; a biasing member for biasing the sleeve towards a second position; and a first flow path formed at least partially by the mandrel and a second flow path formed at least partially by the sleeve, wherein the sleeve is movable towards the second position relative to the mandrel to block the second flow path.

In one or more embodiments described herein, the second flow path is formed at least partially by the mandrel.

In one or more embodiments described herein, the second flow path is formed at least partially by a housing.

In one or more embodiments described herein, the setting tool includes a locking mechanism configured to hold the sleeve in the first position and prevent movement of the sleeve relative to the mandrel in at least one direction.

In one or more embodiments described herein, the first flow path is formed at least partially by a bore of the mandrel.

In one or more embodiments described herein, the second flow path is formed at least partially by a port in the sleeve.

In one or more embodiments described herein, the second flow path is at least partially formed by a port in the mandrel.

In one or more embodiments described herein, the setting tool includes a plurality of second flow paths.

The invention claimed is:

1. A setting tool, comprising:

a housing;

a mandrel disposed in a bore of the housing and connected to the housing;

a sleeve disposed in an annular area between the mandrel and the housing, the sleeve movable from a first position to a second position;

a biasing member for biasing the sleeve towards the second position;

a first fluid flow path through a bore of the mandrel; and a second flow path in the annular area between the mandrel and the housing, wherein the sleeve blocks fluid flow from the first flow path to the second flow path when the sleeve is in the second position and wherein the second fluid path is in fluid communication with a portion of the bore of the housing below the sleeve.

2. The tool of claim 1, wherein the sleeve is releasably locked in the first position.

3. The tool of claim 1, wherein the mandrel includes a port providing fluid communication between the bore of the mandrel and a first side of the sleeve.

4. The tool of claim 3, wherein the sleeve includes a port providing fluid communication through the sleeve.

5. The tool of claim 4, wherein the mandrel includes a second port providing fluid communication between the bore of the housing and a second side of the sleeve.

6. The tool of claim 1, wherein the sleeve is disposed between an upper portion of the annular area and a lower portion of the annular area.

7. The tool of claim 6, wherein the sleeve includes a port providing fluid communication from the upper portion of the annular area to the lower portion of the annular area.

8. The tool of claim 6, wherein the mandrel includes a port in fluid communication with the annular area.

9. The tool of claim 1, further comprising a seat connected to the mandrel.

10. The tool of claim 9, wherein the annular area is in fluid communication with the portion of the bore of the housing below the sleeve.

11. The tool of claim 9, wherein the seat is configured to receive an actuating member.

12. The tool of claim 1, further comprising a locking mechanism configured to hold the sleeve in the first position and prevent movement of the sleeve relative to the mandrel in at least one direction.

13. A method of operating a setting tool, comprising:

flowing fluid through a first fluid path and a second fluid path;

releasing an actuating member;

landing the actuating member in the setting tool, thereby blocking fluid flow through the first fluid path;

flowing fluid from the second fluid path into a portion of the first fluid path below the actuating member;

increasing fluid pressure in the setting tool, thereby moving a sleeve from a first position; and decreasing fluid pressure in the setting tool, thereby moving the sleeve from towards a second position to block fluid flow through the second fluid path.

14. The method of claim 13, further comprising setting a liner after moving the sleeve to the second position.

15. The method of claim 13, further comprising unlocking the sleeve to allow movement towards the second position.

16. The method of claim 15, wherein the sleeve is unlocked by increasing fluid pressure above a predetermined pressure to unlock the sleeve.

17. The method of claim 16, further comprising increasing fluid pressure above a second predetermined pressure, thereby unblocking fluid flow through the first fluid path.

18. The method of claim 13, wherein after the sleeve is in the second position the sleeve cannot move towards the first position.

19. The method of claim 13, wherein fluid flow through the second fluid path is blocked when the sleeve moves to the second position.

* * * * *